United States Patent [19]

Whiteford

[11] Patent Number: 4,492,260

[45] Date of Patent: Jan. 8, 1985

[54] WOODWORKING PLANE

[76] Inventor: Carl Whiteford, 3 High Point Rd., Westport, Conn. 06880

[21] Appl. No.: 484,906

[22] Filed: Apr. 14, 1983

[51] Int. Cl.[3] ..... B27G 17/02

[52] U.S. Cl. ..... 145/5 R; 145/20

[58] Field of Search ..... 7/164; 145/5 R, 20, 145/15

[56] References Cited

U.S. PATENT DOCUMENTS

| | | | |
|---|---|---|---|
| 122,609 | 1/1872 | Holt | 145/5 R |
| 1,559,797 | 11/1925 | Slomer | 145/5 R |
| 1,561,406 | 11/1925 | Caisse | 145/5 R |
| 4,088,165 | 5/1978 | Anderson | 145/5 R |

FOREIGN PATENT DOCUMENTS

| | | | |
|---|---|---|---|
| 870807 | 6/1961 | United Kingdom | 145/5 R |

*Primary Examiner*—Frederick R. Schmidt
*Assistant Examiner*—J. T. Zatarga

[57] ABSTRACT

A plane in which the cutting blade is fixedly mounted, and a portion of the sole plate is adjustable relative to another portion thereof in order to adjust the depth of cut of the plane. As distinguished from conventional planes in which the cutting blade is adjustably mounted for movement along the longitudinal axis of the blade in order to adjust the depth of cut of the plane, the cutting blade of the plane disclosed herein is fixedly mounted with the cutting edge coincident with the lower edge of the sole plate, and a forward portion of the sole plate is movable in a direction perpendicular to the plane of the rearward portion of the sole plate to adjust the depth of cut. The forward handle of the plane performs three functions, specifically to guide the plane during movement across the surface of the material being cut, to provide the means for adjusting the position of the forward portion of the sole plate and as a bubble level to provide a means for determining whether a surface on which the plane is placed is horizontal.

2 Claims, 5 Drawing Figures

WOODWORKING PLANE

BACKGROUND OF THE INVENTION

The plane is a woodworking tool which is frequently used by carpenters, craftsmen, and home workshop enthusiasts for performing various types of planing operations on the faces of boards and the relatively narrow edges of board for accomplishing such functions as jointing, truing, smoothing or finishing. In design it is a relatively simple tool, and with very little exception their designs have remained unchanged for about half a century. Over the years the common plane has been refined to a relatively high degree of operating efficiency, and virtually every plane manufactured and marketed today incorporates features and advantages which were available a long time ago.

The traditional and familiar woodworking plane comprises generally an elongate body having a flat surfaced sole plate which extends from one end of the body to the other. The sole plate defines a broad flat generally iron surface on which the plane slides over the edge or surface of the board being planed. An upstanding handle is connected to the rear end of the body for pushing the plane across the board, and a knob-like handle is mounted at the front end of the body for controlling the movement of the plane. A wide slot is located in the sole plate spaced from the forward end thereof by approximately ¼ the length of the whole sole plate, and the slot extends laterally across most of the width of the sole plate. A cutting blade is adjustably mounted on the inside of the body member so that the plane of the blade forms an acute angle with the plane of the sole plate facing rearwardly and also so that the cutting edge of the blade projects through the slot. The mounting structure on the body for the blade includes means for moving the blade in a linear path so that the cutting blade can be adjustably extended beyond the working surface of the sole plate in order to vary the depth of cut to be made by the plane. Also, means are provided for moving the blade in an arcuate path about a pivot point in order to align the cutting edge of the blade with the bottom or working surface of the sole plate so that the blade will cut to a uniform depth across the width of the plane.

Notwithstanding the relative simplicity of design, conventional planes manufactured according to the design briefly described above are quite massive and heavy in construction and therefore are cumbersome to use and relatively expensive to manufacture. For example, since the slot for the blade extends across virtually the entire width of the sole plate, heavy side portions of the body must be maintained in order to provide sufficient strength and rigidity to the body to prevent it from bending under the stress of the high forces imposed upon them, during use. Also, the body itself is generally made of cast iron which is quite heavy and requires considerable machining to form the rather complex surfaces and shapes which are necessary to accommodate the mounting structure of the blade in order to provide for the multiple forms of movement of the blade. The sole plate is susceptible to rusting and requires frequent polishing, buffing or even re-machining in drastic cases to maintain a smooth sliding surface which offers a minimum of frictional resistance to the sliding movement of the plane. The adjusting mechanism is rather complicated and expensive to manufacture, since it requires a threaded knob and lever arrangement to accommodate the linear movement of the blade and a cam and lever arrangement to accommodate the arcuate movement of the blade. Finally, the blade itself is a relatively long piece of heat treated tool steel that requires a backing plate component as part of the clamping mechanism which secures the blade to the body very securely and yet in such manner that it can be moved in both directions as aforesaid, when in use.

Although the conventional plane may seem at first glance to be a relatively simple tool in terms of mechanical complexity and one which would be relatively easy and inexpensive to manufacture, use and maintain, it should be apparent from the foregoing that quite the contrary is true. Thus there is a great need for a plane which will avoid these disadvantages.

SUMMARY OF THE INVENTION

The present invention relates generally to woodworking tools and more particularly to a plane for performing various cutting operations on the edges and surfaces of wood boards.

Several new features of design in the present invention are embodied in a plane which substantially obviates or completely eliminates the disadvantages of prior art planes, and which provides novel features and advantages not heretofore attainable. The plane of the present invention, as will be described in detail hereinafter, is much lighter than prior art planes since it can be made from aluminum rather than steel. It has an inexpensive, disposable or throwaway cutting blade which is mounted in a very secure fixed position in the body rather than being moveably mounted, and a completely redesigned system for adjusting the depth of cut of the plane, both of which features lead toward a considerable reduction in both the number and complexity of parts. The aluminum sole plate is coated with polytetrafloraethylene, generally known by the trademark TEFLON, so that the plane slides very smoothly and easily over a wooden surface, and a portion of the sole plate, which is adjustable up and down, is made from a composition of very high strength plastic combined with fibers of polytetrafloraethylene, generally known by the trademark DELREN AF, to provide a long lasting wear surface which also reduces friction to a minimum. Thus the plane of the present invention is very light and easy to handle, is very efficient in operation, is long lasting and requires virtually no maintenance, and is considerably less expensive to manufacture than prior art planes.

In its broader aspects, the plane of the present invention comprises an elongate main body member and a moveable forward end member handle means affixed to the body member adjacent the rearward end for moving the body member along an edge of a piece of material to be cut, and a cutting blade precisely but securely mounted in the main body member at the forward end. A sole plate is part of the body member and has a planar bearing surface which slides across the material being planed. The sole plate consists of a rearward portion which extends from the cutting blade toward the rearward end of the body member and which has a fixed position relative to the body member. A separate moveable forward portion extends from the fixed cutting blade toward the forward end of the plane. The main body member includes means for mounting the forward portion of the soleplate for limited movement relative to the rearward or main portion of the plane, and in a direction perpendicular to the plane of the working surface. Finally, there is provided means for adjustably moving the core portion of the forward part of the plane, in order to adjust the depth of the cut being made by the plane during movement across a board.

In some of its more limited aspects, the forward portion of the sole plate is normally disposed so that the bearing surface thereof lies on a plane which is offset but parallel to the bearing surface of the rearward portion in order to define a forwardly facing edge of the rearward portion of the sole plate. This edge forms a backstop or bearing surface for the cutting blade, which is mounted so that the cutting edge of the blade is contiguous with the main working sole plate of the plane. The forward portion of the sole plate is firmly mounted to the main body as a fixed peripheral frame portion and a central disc portion, being moveably mounted in the fixed peripheral frame portion, preferably by means of cooperating screw threads formed on the inner annular surface of the peripheral frame portion and the outer circumferential surface of the central disc portion. In addition, in order to maintain a tight fit between the two threaded members and to hold the central disc portion in its desired set position, the internal threads of the peripheral frame member are formed only on a plurality of resilient arcuate fingers which form part of the fixed peripheral frame. Other arcuate portions of the peripheral frame member, between the resilient fingers having no threads thereon. By this arrangement, since the parts are shaped so that the central disc portion is closely fitted to the threads of resilient fingers on the peripheral frame portion when the latter are in their normal stressed position, the resilient or spring fingers bend slightly when the central disc portion is screwed into position so that they exert a relatively high degree of resistance to movement of the central disc portion, thereby firmly holding the central disc in any set position of rotation.

One of the significant features of the present invention is that the knob-like handle mounted adjacent the front end of the body member functions not only to assist in controlling the movement of the plane but also as the means by which the central disc portion of the forward portion of the sole plate is rotated in order to change the depth of cut of the plane. Still further, the knob is made of a clear plastic material and is hollow inside, and it is substantially filled with a clear liquid except for a small bubble, and the upper surface of the knob is relatively flat with a slight interior curvature. Thus it can function as a bubble level when the plane is placed upon a substantially horizontal surface.

Having briefly described the general nature of the present invention, it is a principal object thereof to provide a plane having new design features which eliminate the disadvantages of prior art planes and which provide advantages not heretofore attainable.

It is another object of the present invention to provide a plane in which a portion of the sole plate is adjustable relative to a fixed rear portion so that the cutting blade can be simply and fixedly mounted, thereby greatly reducing the number and complexity of the parts.

It is still another object of the present invention to provide a plane in which at least one of the handles performs a plurality of functions, serving also as a means for controlling the depth of cut of the plane and as a level indicator.

It is a still further object of the present invention to provide a plane which is light in weight and easy to operate, is relatively simple in construction, inexpensive to manufacture and long lasting and requires substantially no maintenance.

These and other objects and advantages of the present invention will become more apparent from an understanding of the following detailed description of the presently preferred embodiment of the present invention when considered in conjunction with the accompanying drawings in which.

DETAILED DESCRIPTION OF THE PREFERRED EMBODIMENT

Figure 1:
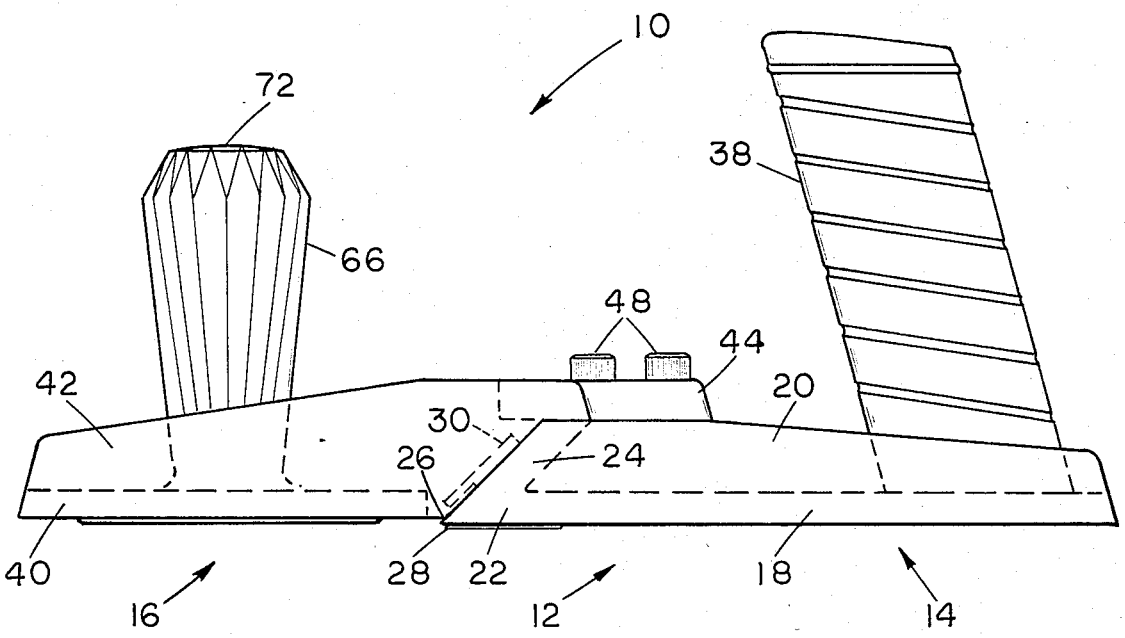
FIG. 1 is a side elevational view of the plane of the present invention.
Figure 2:
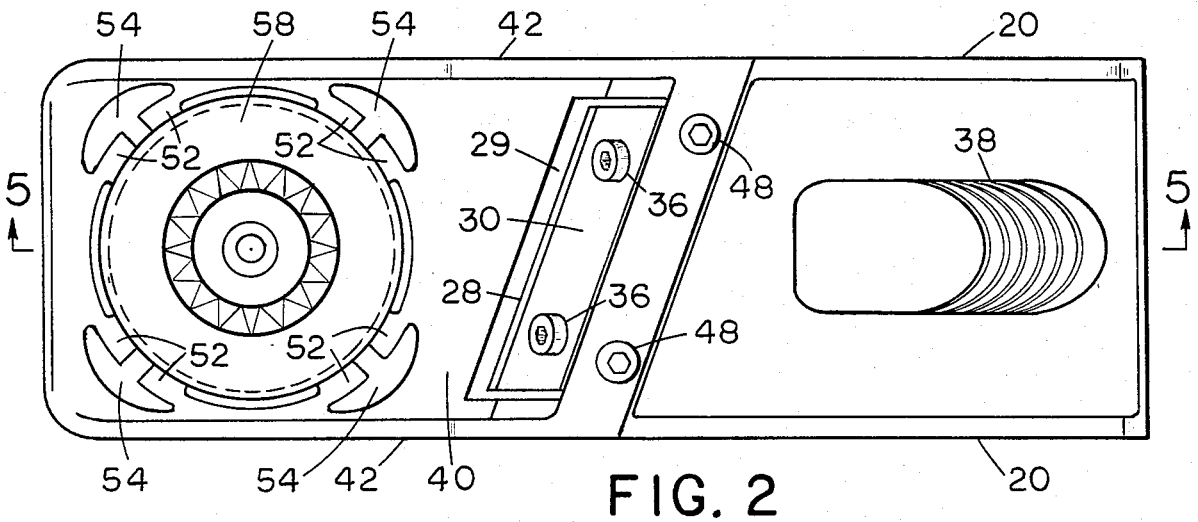
FIG. 2 is plan view of the plane shown in FIG. 1.

Referring now to the drawings and particularly to the FIGS. 1 and 2 thereof, the plane of the present invention, generally designated by the reference numeral 10, is seen to comprise an elongate body member, generally designated by the reference numeral 12, the body having a rearward portion and a forward portion, generally designated by the reference numerals 14 and 16 respectively. The body member 12 comprises a flat channel portion or sole plate 18 which extends from one end of the plane 10 to the other although in a discontinued manner as will be explained below. A pair of upstanding side walls 20 are connected to that portion of the sole plate which is on the rearward portion of the body member, the side walls 20 serving to provide the necessary strength and rigidity to the body member in order to maintain the sole plate absolutely flat during use of the plane. The portion of the sole plate on the rearward portion of the body member terminates forwardly in a front wall 22 which extends upwardly as shown by the numeral 24 to define a forwardly facing wall which is sufficiently high to form the backstop or bearing surface for a cutting blade 26 which is secured thereto. The cutting blade 26 has a cutting edge 28 which extends through a slot 29 and is securely mounted contiguous with the lower plane of the bottom of the plane, and the blade 26 is then retained in place by a retaining plate 30 which has a pair of holes which align with holes in the front wall 24 so that the retaining plate can be connected to the front wall by means of screws 36. This arrangement facilitates a very secure mounting for the blade which, during periods of normal operation, is fixed with respect to the main body member. The blade 26 is of the relatively inexpensive throw-away type, not unlike a typical disposable shaving blade. It may, if desired, be a double-edged blade, and may be honed on a sharpening stone if it seems to be dull during use. However, if the blade were to be seriously nicked so as to require grinding, it would be thrown away and a new blade inserted. If the blade is honed slightly it can be remounted in the plane so that the new cutting edge can still be contiguous with the bottom of the plane. Finally, an upstanding handle 38 is mounted on the rearward portion of the main body member adjacent the rear end thereof, and serves, in the manner of a typical plane, to provide a comfortable means for pushing the plane across the surface of a board.

The forward portion 16 of the body member 12 is seen to comprise an outer peripheral frame portion 40 and a pair of upstanding side walls 42 which have extensions 44 extending rearwardly of the peripheral frame portion 40 and overlying the forward end of the rearward portion 14 of the body member 12. The rearward end of the forward portion 16 and the forward end of the rearward portion 14 have mating surfaces so that the two portions of the body member 12 can be joined together. A lateral connecting wall 46 extends between the side walls 42 and is provided with apertures into which screws 48 are inserted to be threaded into topped holes formed in the upper surface of the wall 24 to securely lock the two portions of the body member together.

It should be noted that the peripheral frame portion 40 of the forward body portion 16 is in a fixed position relative to the rearward body portion 14, and has a sole plate portion which is offset but parallel to the sole plate portion of the rearward body portion 14. The offset relationship of the two body portions of the sole plate 18 result in the forwardly facing wall 24 described above against which the cutting blade 26 rests. The amount of the offset between the two portions of the sole plate would determine the maximum depth of cut which is possible with the plane. However, it is typically desirable to cut to a depth much less than the maximum possible and for this purpose a depth cut adjusting arrangement is provided.

As best seen in FIG. 2, the peripheral frame portion 40 of the forward portion 16 of the body member is formed with a plurality of arcuate fingers 52, a total of 8 such fingers being shown in the drawing. These fingers are defined by voids 54 which are formed in the peripheral frame portion 40, together with the spaces between the ends of adjacent fingers, with the result that the fingers 52 will have a slight degree of resilience in a radial direction with respect to the opening defined by the outer peripheral frame portion. Each of the fingers is provided with threads on the inner annular surface thereof. A central disc portion 58 of the forward body portion is shaped to fit within the opening defined by the resilient fingers, the central disc portion 58 having an outer circumferential surface 60 which is threaded to be complimentary to the threads 56 formed on the inner surface of the resilient fingers 52. The central disc portion 58 has a diameter which is very slightly greater than the diametral distance between opposed pairs of fingers 52 so that in the normal position of the fingers 52 the central disc portion 58 could not easily be threaded into the resilient fingers 52. However, upon slight deformation of the resilient fingers 52, the central disc portion can be threaded into the resilient fingers 52 with the result that the fingers 52 will exert a substantially high degree of frictional resistance to rotation of the central disc portion 58. By this construction, it can be seen that as the central disc portion 58 is rotated, the under side thereof is moved toward and away from the plane defined by the bearing surface on the under side of the sole plate 18, that is in a direction perpendicular to the plane of the bearing surface of the sole plate 18. The more the central disc portion 58 is threaded into the resilient fingers 52, the closer the bearing surface of the central disc portion 58 is brought to the plane of the bearing surface of the rear portion of the sole plate 18, and consequently the more the depth of cut will be reduced when the plane is in use. The central disc portion 58 is made from a composition of a very high strength wear resistant plastic material such as that sold under the trademark DELREN AF. The composition includes polytetrafloraethylene fibers which provide a relatively friction-free surface.

Referring again to FIG. 5, it will be seen that the central disc portion 58 is itself provided with a central boss 64 which provides a means for threadedly receiving a handle 66 which serves the functions both of providing control for the movement of the plane along the edge surface of the board as well as the means by which the central disc portion 58 is rotated in a clockwise or counter-clockwise direction in order to change the depth of cut as described above.

Figure 3:
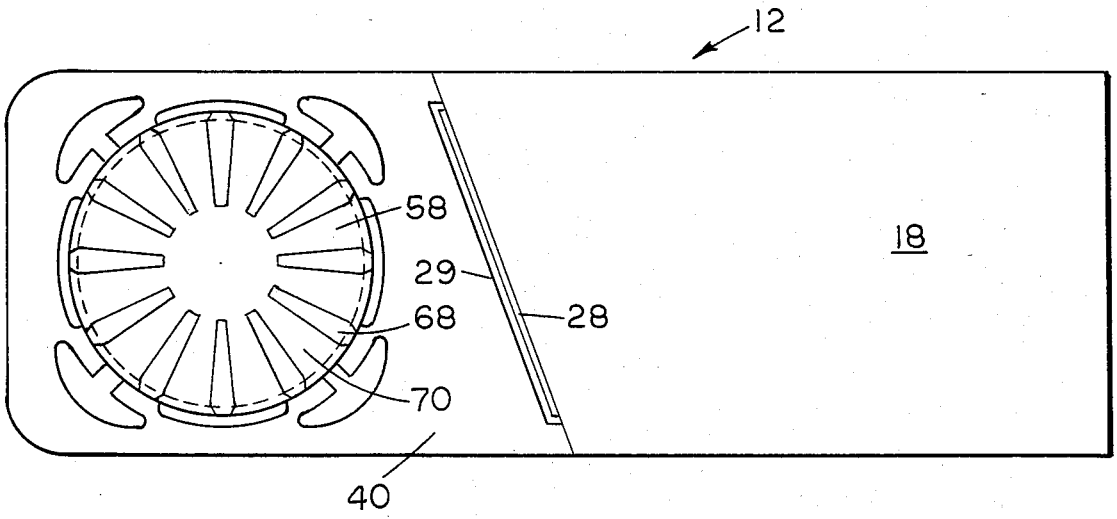
FIG. 3 is a bottom view of the plane shown in FIG. 1.

Referring to FIG. 3, it will be seen that the under side of the central disc portion 58 is provided with a plurality of generally radially extending bearing surfaces 68 which are raised above the bottom surface of the central disc portion 58, these radial bearing surfaces providing radial spaces 70 therebetween, so that wood shavings and dust are not trapped between an otherwise completely flat bearing surface and the surface of the wood. In other words, the radial spaces 70 are intended to provide space for wood shavings and dust to exit from between the under side of the central disc portion 58 and the surface of the wood as the plane is moved over the surface of the wood.

Figure 5:
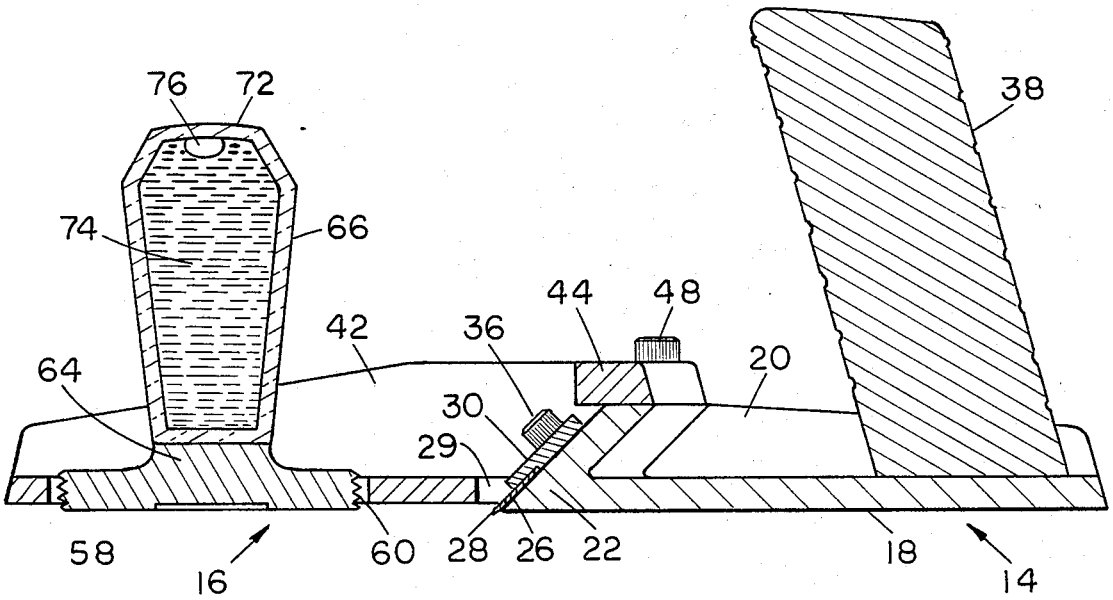
FIG. 5 is a longitudinal sectional view taken on the line 5—5 of FIG. 2.
Figure 4:
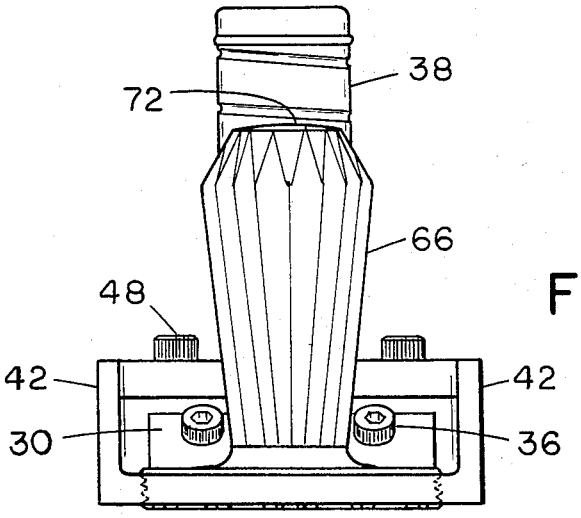
FIG. 4 is a front view of the plane shown in FIG. 1.

As best seen in FIGS. 4 and 5, the forward handle 66 is formed of a transparent plastic material and has a slightly curved top 72. The handle is molded as a pair of shells so as to have a hollow cavity 74 which is substantially filled with a liquid except for a small bubble 76. The outer surface of the top wall 72 is provided with sight lines 78 so that the handle 66 can function as a level. When the plane 10 is placed upon a horizontal or substantially horizontal surface, one can tell whether or not the surface is horizontal by determining whether or not the bubble 76 is centered within the sight lines 78 provided on the top wall 72. Thus, the handle 66 actually serves three separate functions, the first as a handle for controlling the movement of the plane 10 across the wood surface, the second as the means for operating the adjustable central disc member 58 of the forward section 16 of the body member, and finally as a bubble level for determining whether or not the surface upon which the plane is resting lies in a horizontal plane, in all directions.

I claim:

1. A plane for straightening and smoothing surfaces of wood and the like comprising:

A. an elongate body member having forward and rearward sections,

B. handle means affixed to said body member adjacent said forward and rearward sections for moving said body member along a piece of material being cut, C. a cutting blade mounted in said rearward section of said body member, D. a sole plate as part of said body member, said sole plate defining a planar bearing surface on which said body member slides across the material being planed, said sole plate having (1) a rearward section which extends from said cutting blade toward said rearward end of said body member and which has a fixed position relative to said bosy member, and (2) a forward section which extends from said cutting blade toward said forward end of said body member, said forward section of said sole plate comprising a peripheral frame section which is fixed relative to said rearward section of said sole plate and which defines an opening therein and a central disc member carried by said peripheral frame section within said opening, E. means mounting a portion of said forward section of said sole plate for limited movement relative to said rearward section of said sole plate in a direction perpendicular to the plane of said bearing surface, said means comprising connection means operatively associated with said peripheral frame section and said central disc member for moving said central disc member relative to said peripheral frame section and for holding said central disc member in a pre-selected position relative to said peripheral frame section, said connecting means comprising (1) female screw threads formed on the interior annular surface of said opening and complimentary male threads formed on the exterior circumferential surface of said central disc member, and (2) means operatively associated with said peripheral frame section and said central disc member for restraining relative rotary movement between said peripheral frame section and said central disc member, said means comprising a plurality of arcuately elongate resilient fingers formed in said peripheral frame section adjacent said opening, said female threads being formed only on said resilient fingers, the diametral distance between opposed resilient fingers in the unstressed position thereof being slightly less than the diameter of said central disc member, whereby upon engagement of said central disc member with said peripheral frame section said resilient fingers flex slightly and engage said central disc member with high frictional resistence to relative movement, and F. means for adjustably moving said portion of said forward section of said sole plate in order to adjust the depth of the cut made by said plane during movement thereof across the material being planed.

2. A plane as set forth in claim 1 wherein said means for adjustably moving said central disc member comprises handle means adjacent said forward end of said body member mounted on said central disc member of said forward section of said body member, whereby said handle serves both to control the movement of said plane and also to rotate said central disc member, said handle means comprising an upstanding knob having a shape suitable for being conveniently grasped by the hand of the user, said knob being formed of a clear transparent plastic material and being hollow to form a cavity which is substantially filled with a liquid except for a small air bubble, said knob having an upper wall which is curved slightly to be concave inwardly and has a sight line thereon, whereby said handle means functions as a bubble level when said plane is placed on a surface.

* * * * *